US007505183B2

(12) United States Patent
Kuo et al.

(10) Patent No.: US 7,505,183 B2
(45) Date of Patent: Mar. 17, 2009

(54) MEDIA FEEDING DEVICE WITH SCANNING AND FIXING FUNCTIONS FOR TRANSPARENT DOCUMENTS

(75) Inventors: Shih-Yuan Kuo, Yonghe (TW); Ming-Shien Wang, Sansia Township, Taipei County (TW)

(73) Assignee: Lite-On Technology Corporation, Taipei (TW)

( * ) Notice: Subject to any disclaimer, the term of this patent is extended or adjusted under 35 U.S.C. 154(b) by 733 days.

(21) Appl. No.: 11/033,775

(22) Filed: Jan. 12, 2005

(65) Prior Publication Data

US 2006/0012103 A1 Jan. 19, 2006

(30) Foreign Application Priority Data

Jul. 13, 2004 (TW) ..... 93211014 U

(51) Int. Cl.
*B65H 5/00* (2006.01)
*G03G 15/00* (2006.01)

(52) U.S. Cl. ..... 358/487; 358/498

(58) Field of Classification Search ..... 347/129, 347/112, 111; 358/474, 471, 400, 1.12, 487, 358/498; 399/361, 369; 271/8.1, 10.01
See application file for complete search history.

(56) References Cited

U.S. PATENT DOCUMENTS 4,951,092 A * 8/1990 Ito ..... 399/6
5,239,392 A * 8/1993 Suzuki et al. ..... 358/474
6,054,707 A * 4/2000 Hou ..... 250/234
6,252,684 B1 * 6/2001 Lin ..... 358/498
6,567,191 B1 * 5/2003 Huang ..... 358/487

FOREIGN PATENT DOCUMENTS

JP 2003330131 A * 11/2003

* cited by examiner

*Primary Examiner*—Gabriel I Garcia
(74) *Attorney, Agent, or Firm*—Apex Juris, pllc; Tracy M Heims

(57) ABSTRACT

A media feeding device on an image scanning device which is installed with a transparent supporting board where the media feeding device has a paper tray, a feeding module and a document illumination module. The paper tray accommodates normal opaque documents. The feeding module is connected to the paper tray and it includes paper-feeding rollers to pick one of the normal opaque documents and then feeds it to the transparent supporting board. The document illumination module is embedded on one side of the image scanning device corresponding to the feeding module, and further has a fixing frame and an illumination unit, wherein the fixing frame is installed at the bottom of the feeding module in a movable way, and the illumination unit provides a beam for the image scanning device scanning the normal opaque document to obtain the image data of the normal opaque document.

4 Claims, 4 Drawing Sheets

MEDIA FEEDING DEVICE WITH SCANNING AND FIXING FUNCTIONS FOR TRANSPARENT DOCUMENTS

FIELD OF INVENTION

The invention relates to a media feeding device and, in particular, to a media feeding device with scanning and fixing functions for transparent documents, where the media feeding device can accommodate and accurately position films or negative films for scanning.

RELATED ART

Image scanning devices such as scanners, printers or multi-function peripherals (MFP) that integrate printing, copying, scanning, and faxing functions have long become important processing products in business offices.

According to different paper feeding methods, these scanning devices can be divided into platform or automatic feeding types. The platform type has a transparent glass embedded on the image scanner for the disposition of documents. An image capture unit is then used to scan data on the documents. A popular design of these products is to provide an additional automatic feeder on top of the image scanner. In this manner, the user does not need to open the top cover, so that the user can simply place documents in the paper tray of the automatic feeder, which automatically feeds the documents to its bottom. The image capture unit then reads the data thereon.

When scanning transparent documents such as films or negative films, one usually has to purchase an additional backlit module and use it to replace the automatic feeder on the image scanner. Currently, there are also designs that integrate the backlit module onto the automatic feeder, as shown in FIG. 1, an accommodation space is formed at the bottom of the automatic feeder 100. A lamp 120 and a backlit board 110 are installed therein.

Moreover, the U.S. Pat. No. 6,252,684 also discloses a similar technique that has a backlit source in the automatic feeder for the image capture unit to read data on documents. In summary, although the prior art can function reasonably and achieve certain effects, there is still some inconvenience. The reason sits in that the sizes of transparent documents such as films or negative films are far smaller than the A4 paper commonly used in offices. Therefore, these transparent documents cannot be accurately positioned. The obtained image data thus inevitably have leaning distortions. Such effects require the user to perform subsequent corrections or modification using some image processing software.

SUMMARY OF THE INVENTION

In view of the foregoing, the invention provides a media feeding device with scanning and fixing functions for transparent documents, and the invention can accurately position transparent documents such as films or negative films to avoid image leaning and distortions.

The disclosed media feeding device with scanning and fixing functions for transparent documents is installed on an image scanning apparatus. The media feeding device contains at least a paper tray, a feeding module, a document illumination module, and a document pressing board. The paper tray accommodates external documents for scanning. The feeding module is connected to the paper tray and has a plurality of paper-feeding rollers for picking a scanning document and sending it to a transparent support board on top of the image scanning device. The image scanning device then scans the documents in the paper tray. The document illumination module is installed at the bottom of the feeding module. The document illumination module is comprised of an illumination unit providing a beam for scanning operations and a fixing frame for the disposition of external transparent documents such as films or negative films. The user can take down the fixing frame and replace it by the document pressing board. The document pressing board is installed at the bottom of the feeding module to cover the illumination unit in a movable way. Therefore, the invention allows the image scanning device to perform usual document scanning operations in either the platform or the automatic feeding means.

In addition to normal document scanning operations, the disclosed media feeding device with scanning and fixing functions can expose the document illumination module for scanning transparent documents such as films or negative films after taking off the document pressing board. The image leaning problem in the prior art is thus solved. With the fixing frame, the transparent documents such as films or negative films can be precisely positioned to obtain non-leaning image data.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
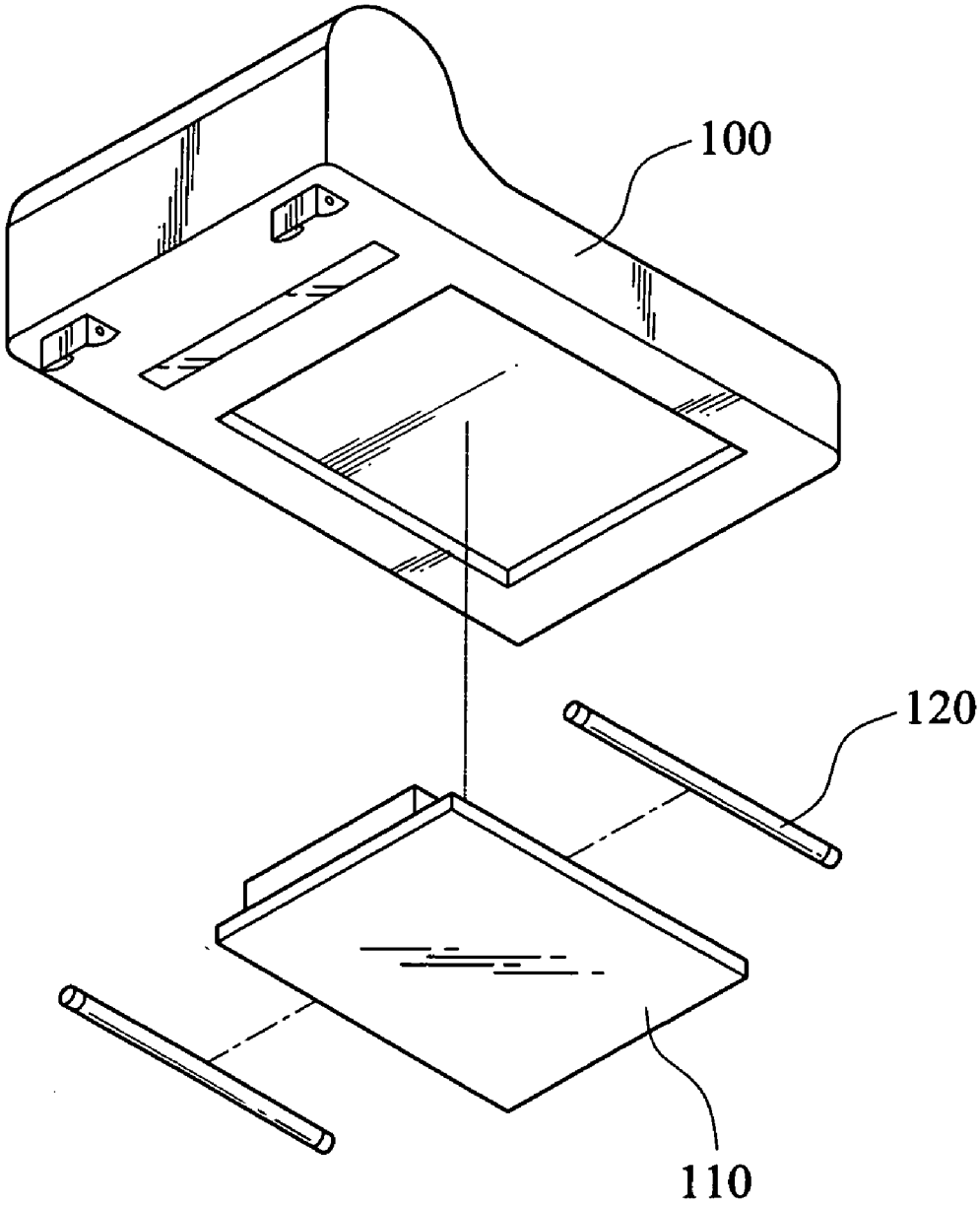
FIG. 1 (PRIOR ART)
FIG. 1 is a schematic of a conventional media feeder.
Figure 2:
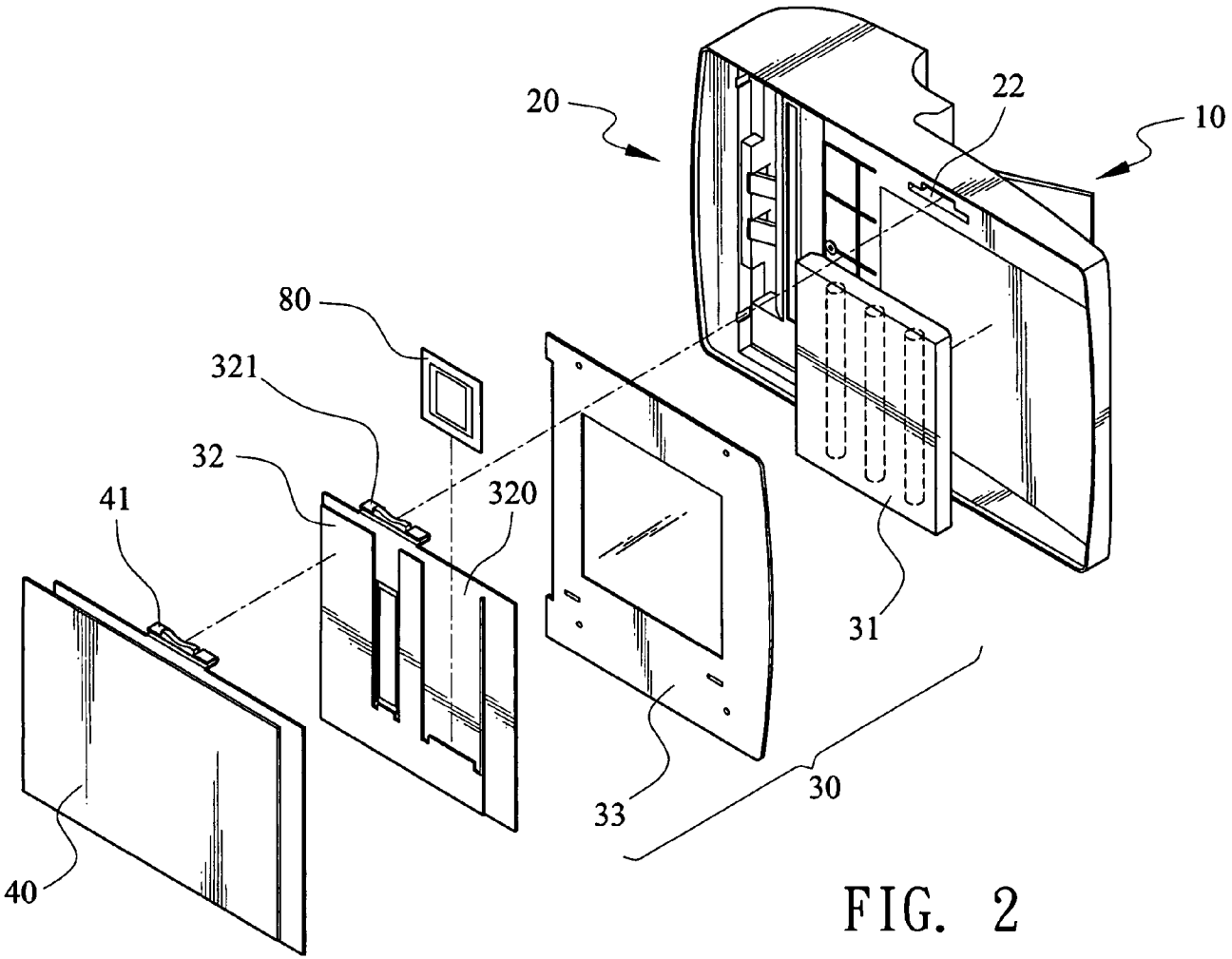
FIG. 2 is an exploded view of the disclosed media feeding device with scanning and fixing functions for transparent documents.
Figure 3:
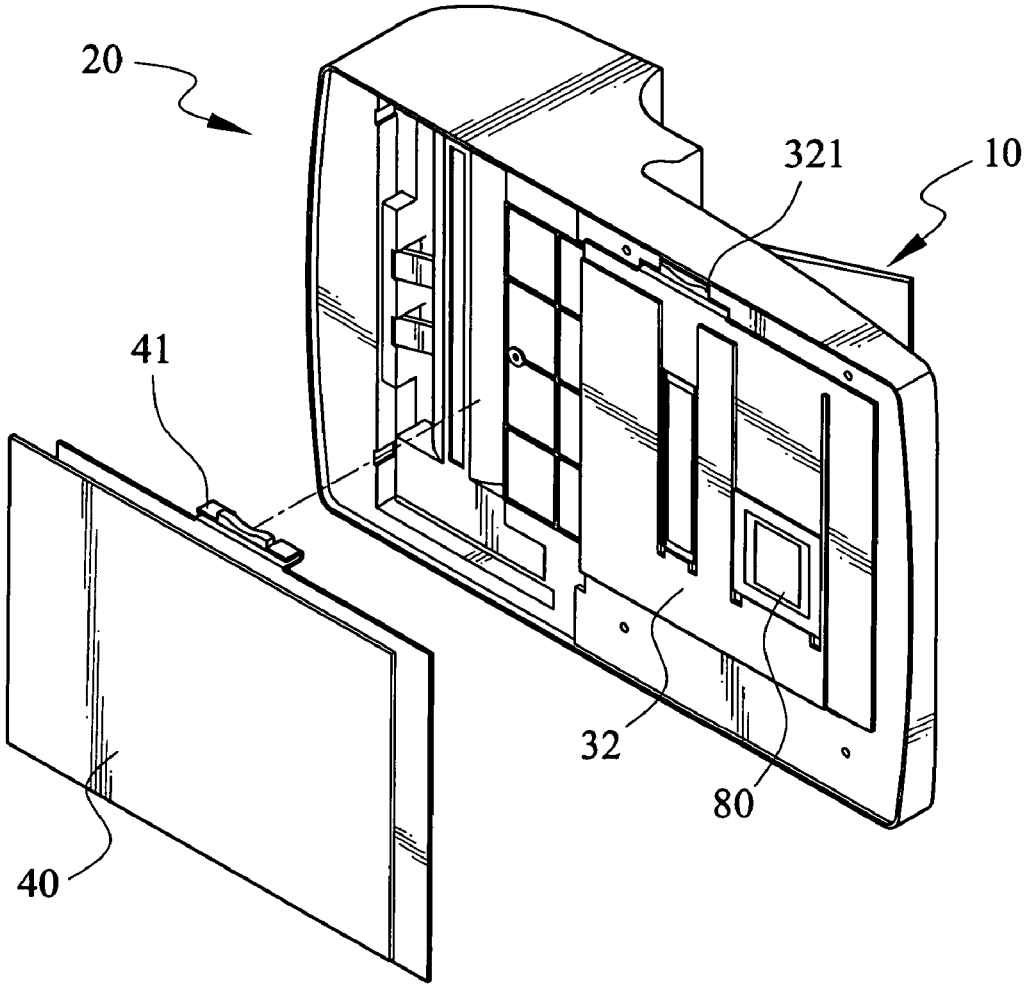
FIG. 3 is a configuration view of the disclosed media feeding device with scanning and fixing functions for transparent documents.
Figure 4:
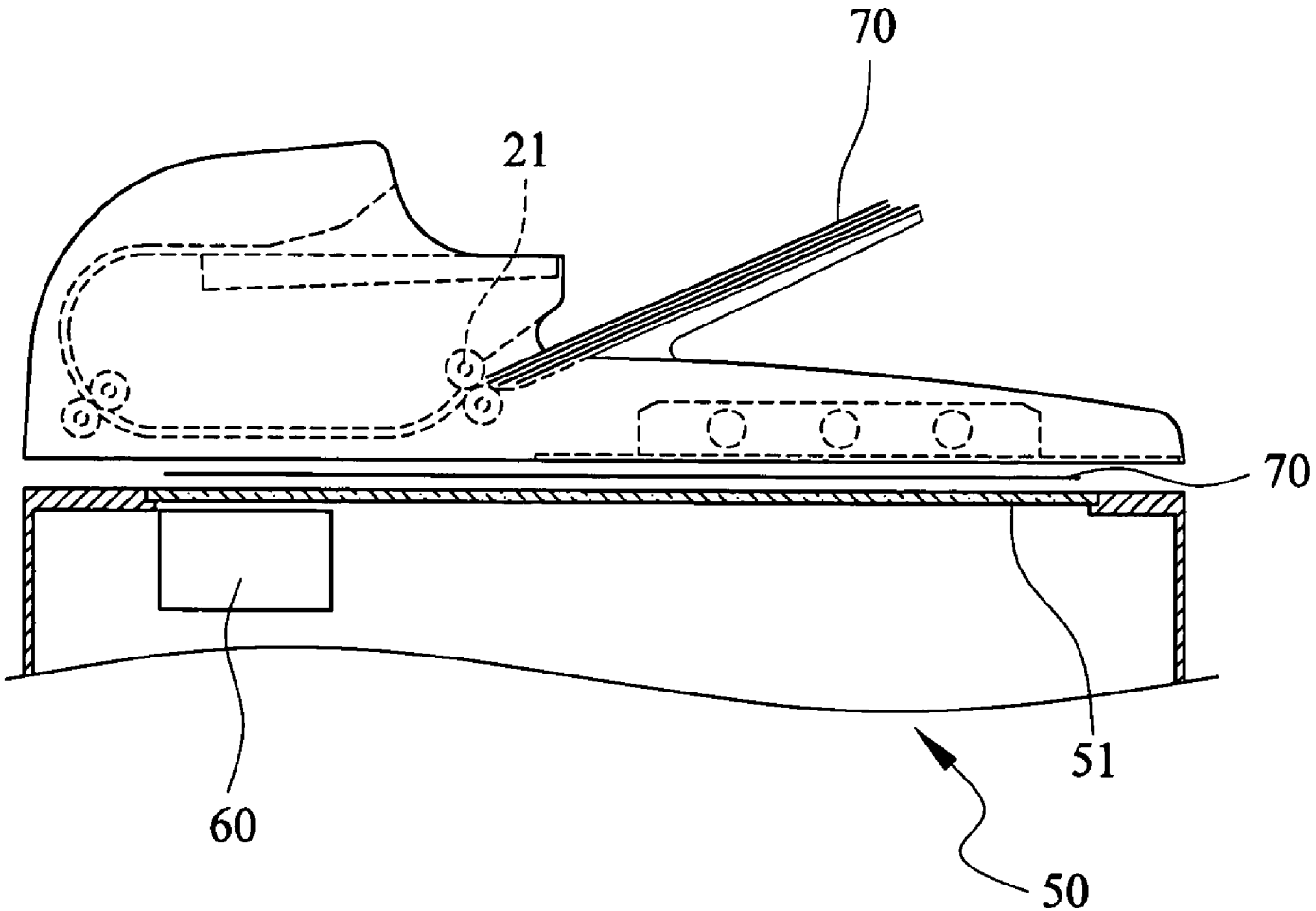
FIG. 4 is side cross-sectional view of the disclosed media feeding device with scanning and fixing functions for transparent documents.

The disclosed media feeding device with scanning and fixing functions for transparent documents is shown in FIGS. 2, 3, and 4. The invention can be installed in an image scanning device such as a scanner, printer, or multi-function peripheral (MFP) that integrates printing, copying, scanning, and faxing functions. The invention mainly contains a paper tray 10, a feeding module 20, a document illumination module 30, and a document pressing board 40. The paper tray 10 accommodates external documents 70 to be scanned. The feeding module 20 is connected to the paper tray 10. The feeding module 20 has several paper-feeding rollers 21 to pick and feed in the documents 70. The documents 70 are sent to the bottom of the feeding module 20. The image scanning operation is performed using the scanner module 60 under the transparent supporting board 51. The internal paper transmission mechanism inside the feeding module 20 is a fairly mature technique; there are many designs in the field to achieve the desired effects. Therefore, we do not show them in the drawings.

The document illumination module 30 is embedded at the bottom of the feeding module 20. The document illumination module 30 contains an illumination unit 31, a fixing frame 32, and a light distributor 33. The fixing frame 32 is installed at the bottom of the feeding module 20 is a removable means. One side of the fixing frame 32 has a lock handle 321. The feeding module 20 is correspondingly installed with a lock hole 22 for the lock handle 321. The combination of the lock handle 321 and the lock hole 22 fixes the fixing frame 32 at the bottom of the feeding module 20. The fixing frame 32 has several openings 320 for the disposition of external transparent documents 80 such as films or negative films. The fixing frame 32 is fixed inside the fixing frame 32. The fixing frame 32 is formed with an illumination region 322 for the light from the illumination unit 31 to pass through. The illumination region 322 provides the light needed for scanning the transparent documents 80 inside the fixing frame 32. The document illumination module 30 can be further installed with a light distributor 33 so that the light emitted by the illumination unit 31 can be homogeneously projected onto the transparent documents 80. After fixing the transparent documents 80 in the fixing frame 32, the transparent documents 80 can be accurately positioned relative to the image scanner 50. The scanner module 60 of the image scanning device then scans the transparent documents 80 to obtain the image data.

As shown in FIGS. 3 and 4, if the user wants to scan normal documents, a force should be imposed on the lock handle 321 in order to unlock it from the lock hole 22. The fixing frame 32 is replaced by the document pressing board 40, covering the illumination unit 31 of the document illumination module 30. The document pressing board 40 is also provided with a lock handle 41 on one side as the fixing frame 32. The document pressing board 40 is fixed at the bottom of the feeding module 20 through the lock handle 41 and the lock hole 22. In this manner, the normal opaque documents 70 on the transparent supporting board 51 of the image scanning device 50 is scanned with the light from the scanner module 60.

In addition to scanning normal documents, the invention can selectively expose the document illumination module 20 by taking off the document pressing board 40 to scan transparent documents 80 such as films or negative films. In particular, the image leaning problem in the prior art is thus solved. With the fixing frame, the transparent documents such as films or negative films can be precisely positioned to obtain non-leaning image data. The invention provides the image scanning function for both normal and transparent documents. The invention has a simple composition and is easy to use.

Certain variations would be apparent to those skilled in the art, which variations are considered within the spirit and scope of the claimed invention.

What is claimed is:

1. A media feeding and transparent media placement device with scanning and fixing functions, for both normal opaque documents and transparent documents, on an image scanning device comprising:

a paper tray, which accommodates a plurality of external documents to be scanned;

a transparent supporting board on top of said image scanning device;

a feeding module, which is connected to the paper tray and includes a plurality of paper-feeding rollers to pick one of the external documents and feeds it to the transparent supporting board for the image scanning device to scan;

a document illumination module, which is embedded on one side of the image scanning device corresponding to the feeding module and where said illumination module provides a beam for the image scanning device to obtain image data of an external document;

a removable document pressing board installed at the bottom of the feeding module to cover the illumination module and for use with the automatic document feeder to scan normal opaque documents;

a removable fixing frame positioned underneath the feeding module that includes an illumination region for the accurate positioning and placement of an external transparent document, such as a transparency or a negative film, wherein said fixing frame is installed in place of and is interchangeable with the removable document pressing board.

2. The media feeding device with scanning and fixing functions for transparent documents of claim 1, wherein one end of the fixing frame is provided with a lock handle, and the feeding module is correspondingly formed with a lock hole for the lock handle to lock into the lock hole, thereby securing the fixing frame to the feeding module.

3. The media feeding device with scanning and fixing functions for transparent documents of claim 1, wherein the document illumination module contains a light distributor for homogeneously distributing the beam provided by the illumination unit onto the external transparent document positioned inside the fixing frame.

4. The media feeding device with scanning and fixing functions for transparent documents of claim 1, wherein one end of the document pressing board is provided with a lock handle, and the feeding module is correspondingly formed with a lock hole for the lock handle to lock into the lock hole, thereby fixing the document pressing board on the feeding module.

* * * * *